US008936232B2

(12) United States Patent
Kowalski et al.

(10) Patent No.: US 8,936,232 B2
(45) Date of Patent: Jan. 20, 2015

(54) INTERLOCK SYSTEM

(75) Inventors: Thomas Kowalski, Franklin, WI (US); Frank R. Szpek, Franklin, WI (US); Mark Medenwaldt, Oak Creek, WI (US); David Bienfang, Racine, WI (US)

(73) Assignee: Caterpillar Global Mining LLC, Peoria, IL (US)

( * ) Notice: Subject to any disclaimer, the term of this patent is extended or adjusted under 35 U.S.C. 154(b) by 252 days.

(21) Appl. No.: 13/561,184

(22) Filed: Jul. 30, 2012

(65) Prior Publication Data

US 2013/0043339 A1 Feb. 21, 2013

Related U.S. Application Data

(60) Provisional application No. 61/524,641, filed on Aug. 17, 2011.

(51) Int. Cl.

| | |
|---|---|
| ***B66D 5/02*** | (2006.01) |
| ***E02F 9/20*** | (2006.01) |
| ***B66D 1/14*** | (2006.01) |

(52) U.S. Cl.

CPC ..... *E02F 9/2016* (2013.01); *B66D 1/14* (2013.01)

USPC ..... 254/375; 254/356

(58) Field of Classification Search

USPC ..... 254/266, 323, 356, 362, 375

See application file for complete search history.

(56) References Cited

U.S. PATENT DOCUMENTS

| | | | | |
|---|---|---|---|---|
| 1,759,292 | A | 5/1930 | Barclay | |
| 3,337,245 | A | 8/1967 | Prange | |
| 3,604,684 | A | 9/1971 | Eithun et al. | |
| 4,379,502 | A | 4/1983 | Ball et al. | |
| 4,646,924 | A | 3/1987 | Dayson | |
| 4,903,511 | A | 2/1990 | Niedzielski et al. | |
| 5,002,259 | A | 3/1991 | Manning et al. | |
| RE36,216 | E * | 6/1999 | Telford | 254/375 |
| 7,222,700 | B2 | 5/2007 | Elliott | |
| 7,344,465 | B2 | 3/2008 | Swick et al. | |
| RE40,869 | E | 8/2009 | Leslie et al. | |
| 2007/0137542 | A1 * | 6/2007 | Falb | 114/104 |

FOREIGN PATENT DOCUMENTS

| | | |
|---|---|---|
| JP | 2003-054879 | 2/2003 |
| JP | 2003054879 | 2/2003 |

OTHER PUBLICATIONS

International Search Report for International Application No. PCT/US2012/049411 dated Feb. 20, 2013, 3 pages.

* cited by examiner

*Primary Examiner* — Emmanuel M Marcelo

(74) *Attorney, Agent, or Firm* — Foley & Lardner LLP

(57) ABSTRACT

A hoist includes a platform, a drum, and a motor. The drum is supported by and configured to rotate with respect to the platform, and the motor is coupled to the drum and configured to rotate the drum. The hoist further includes a shaft having a splined section and an interlock system configured to constrain rotation of the shaft. The shaft is coupled to at least one of the drum and the motor, and communicates torque between the drum and the motor. The interlock system includes a keyed ring and an arm. The keyed ring is configured to slide onto and engage the splined section of the shaft. The arm extends from the keyed ring and is configured to provide leverage to limit rotation of the keyed ring, thereby interlocking rotation of the shaft when the keyed ring is engaged with the splined section of the shaft.

18 Claims, 10 Drawing Sheets

INTERLOCK SYSTEM

This application is based upon and claims the benefit of priority from U.S. Provisional Application No. 61/524,641 by Thomas Kowalski et al., filed Aug. 17, 2011, the contents of which are expressly incorporated herein by reference.

BACKGROUND

The present disclosure relates generally to an interlock system. The system is particularly adapted for use with heavy equipment, such as heavy equipment for mining or construction purposes. More particularly, the present disclosure relates to an interlock system on a hoist used with heavy equipment.

Some forms of heavy equipment, such as a power shovels or draglines, typically include one or more hoists, which wind and unwind rope (e.g., wire rope or cable) on a drum to operate tools of the heavy equipment. The tools may include large buckets that move earth. Periodically, the hoist for such heavy equipment may require maintenance, inspection, repair, etc. In such instances, the hoist may be interlocked to prevent inadvertent release of the rope. However, the process of interlocking the hoist may be cumbersome, requiring the combined efforts of multiple workers.

SUMMARY

One embodiment of the invention relates to a hoist, which includes a platform, a drum, and a motor. The drum is supported by and configured to rotate with respect to the platform, and the motor is coupled to the drum and configured to rotate the drum. The hoist further includes a shaft having a splined section and an interlock system configured to constrain rotation of the shaft. The shaft is coupled to at least one of the drum and the motor, and communicates torque between the drum and the motor. The interlock system includes a keyed ring and an arm. The keyed ring is configured to slide onto and engage the splined section of the shaft. The arm extends from the keyed ring and is configured to provide leverage to limit rotation of the keyed ring, thereby interlocking rotation of the shaft when the keyed ring is engaged with the splined section of the shaft.

Alternative exemplary embodiments relate to other features and combinations of features as may be generally recited in the claims.

BRIEF DESCRIPTION OF THE FIGURES

The disclosure will become more fully understood from the following detailed description, taken in conjunction with the accompanying figures, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
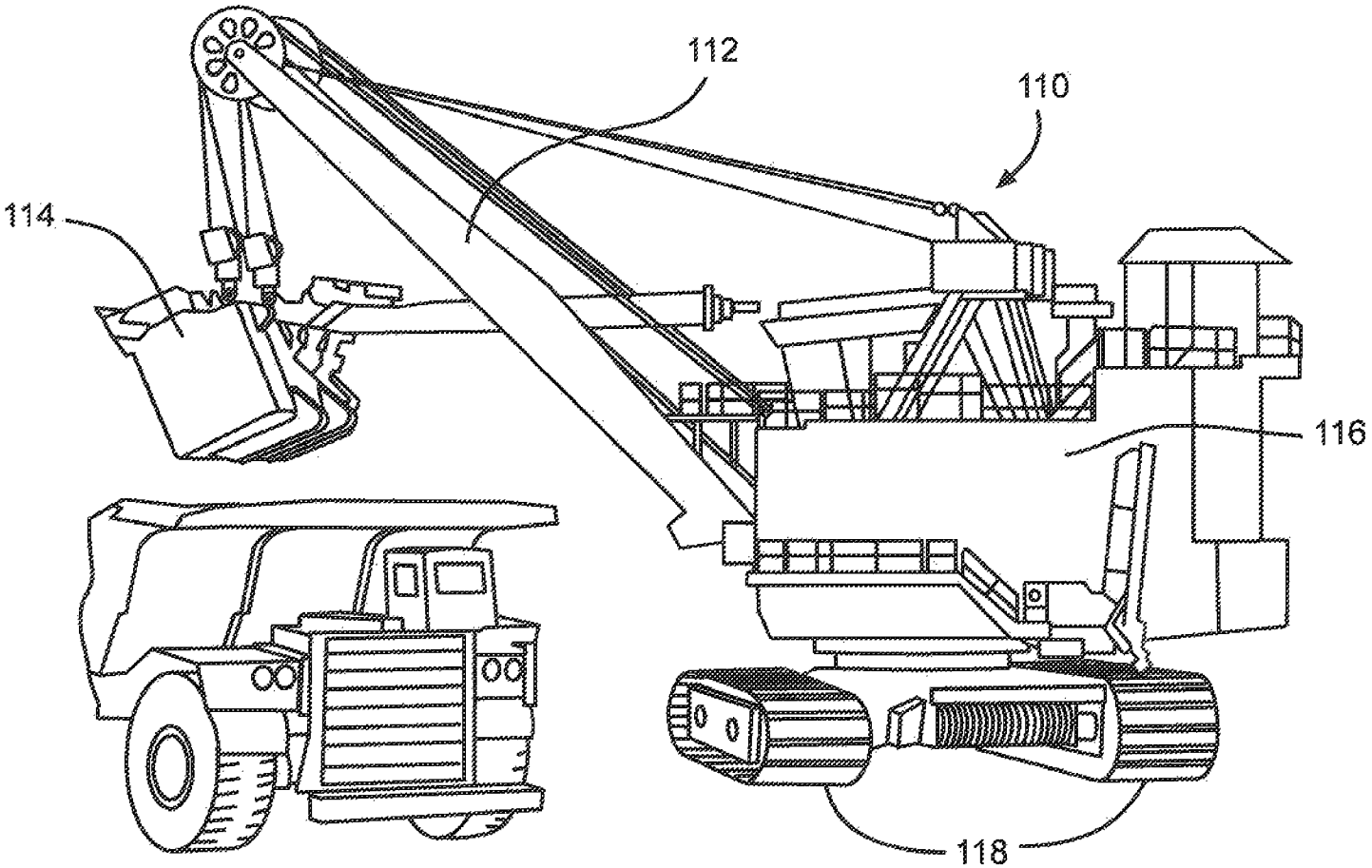
FIG. 1 is perspective view of a power shovel according to an exemplary embodiment.
Figure 2:
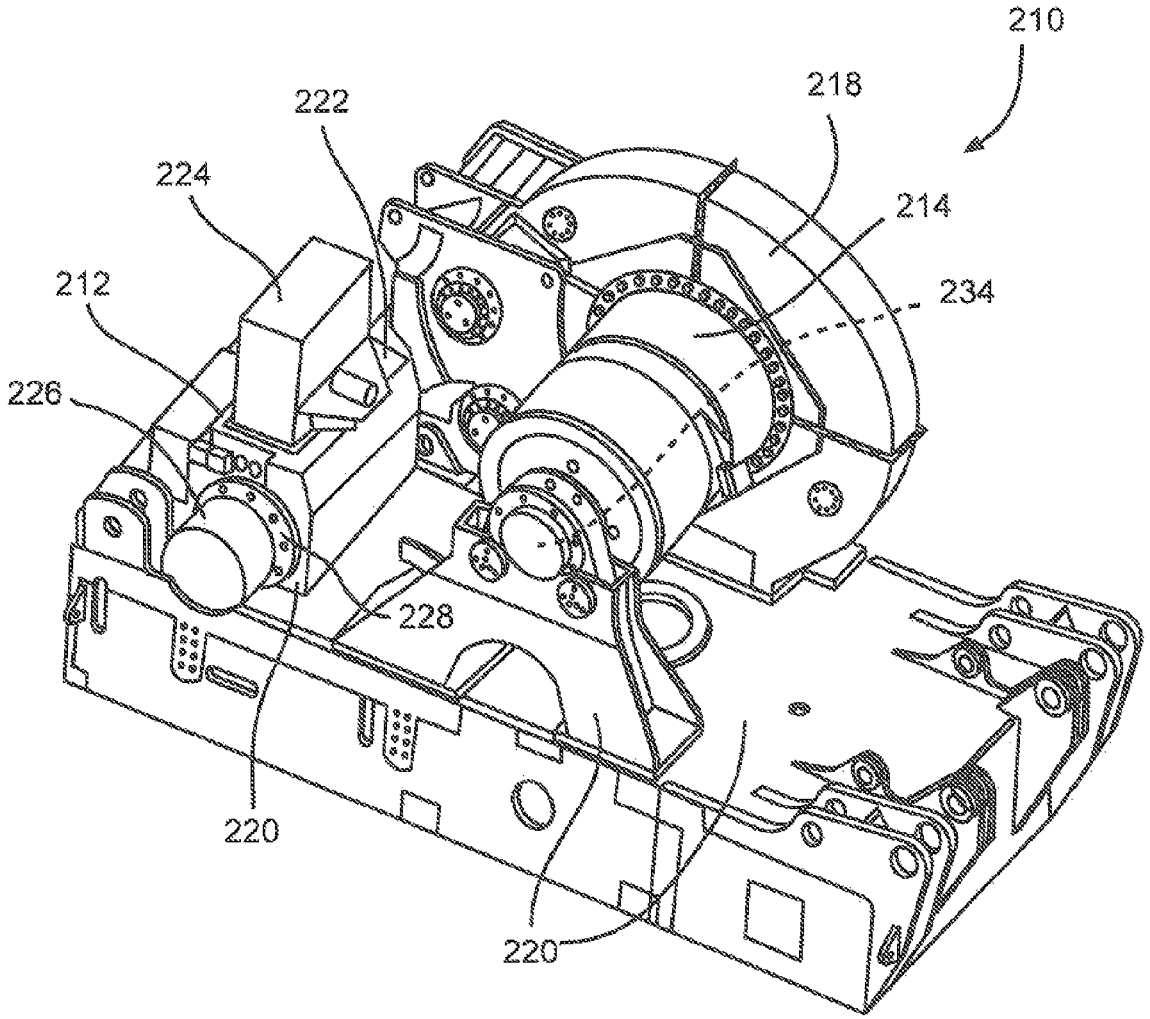
FIG. 2 is a perspective view of a hoist according to an exemplary embodiment.

Referring to FIG. 1, a power shovel 110 includes a boom 112 and a dipper 114 or bucket coupled to a deck 116 of the power shovel 110. The deck 116 is configured to rotate about a mechanism for moving the power shovel 110 along the ground, such as tracks 118, wheels, pontoons, etc. An operator may control the dipper 114 to remove overburden or move other materials, generally for mining or construction purposes. In some embodiments, the dipper 114 may be raised and lowered with ropes (e.g., steel cable or wire rope) that are wound and unwound on a hoist or winch generally located in the interior of the deck 116 (see, e.g., hoist 210 as shown in FIG. 2). The ropes may be made of any material or construction used in surface or underground mining, construction, and similar equipment. Some such ropes may include, for example, thermal plastic encasement or lubrication materials. The ropes may be made of various strands of material or otherwise. Such ropes may be of various dimensions, generally ranging, for example, from an inch to five inches in diameter. While FIG. 1 shows a power shovel, other forms of heavy equipment, such as draglines, mining hoists, electric rope shovels, etc., may benefit from the disclosure provided herein.

Figure 3:
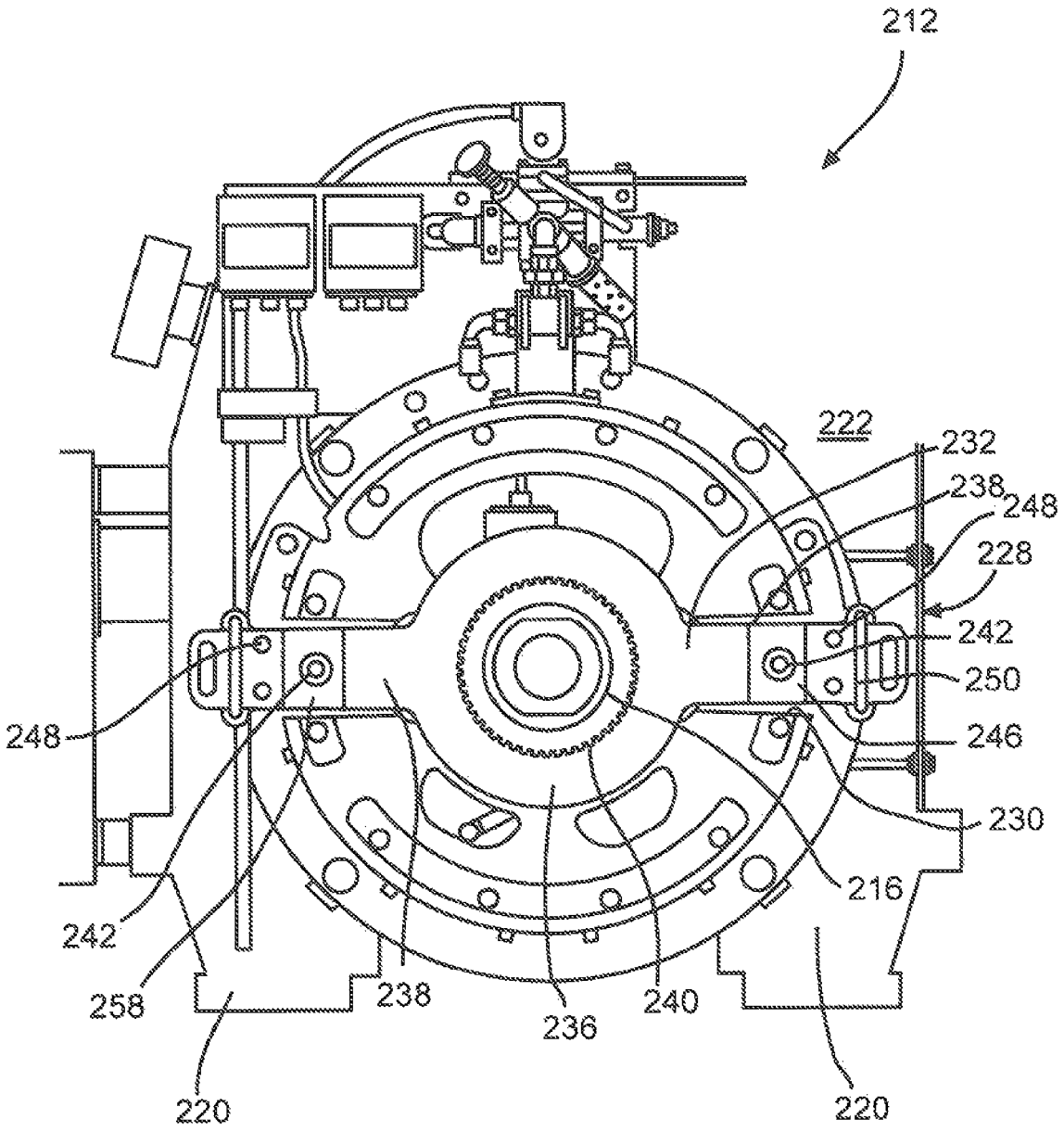
FIG. 3 is a side view of a motor and an interlock system of the hoist of FIG. 2.
Figure 10:
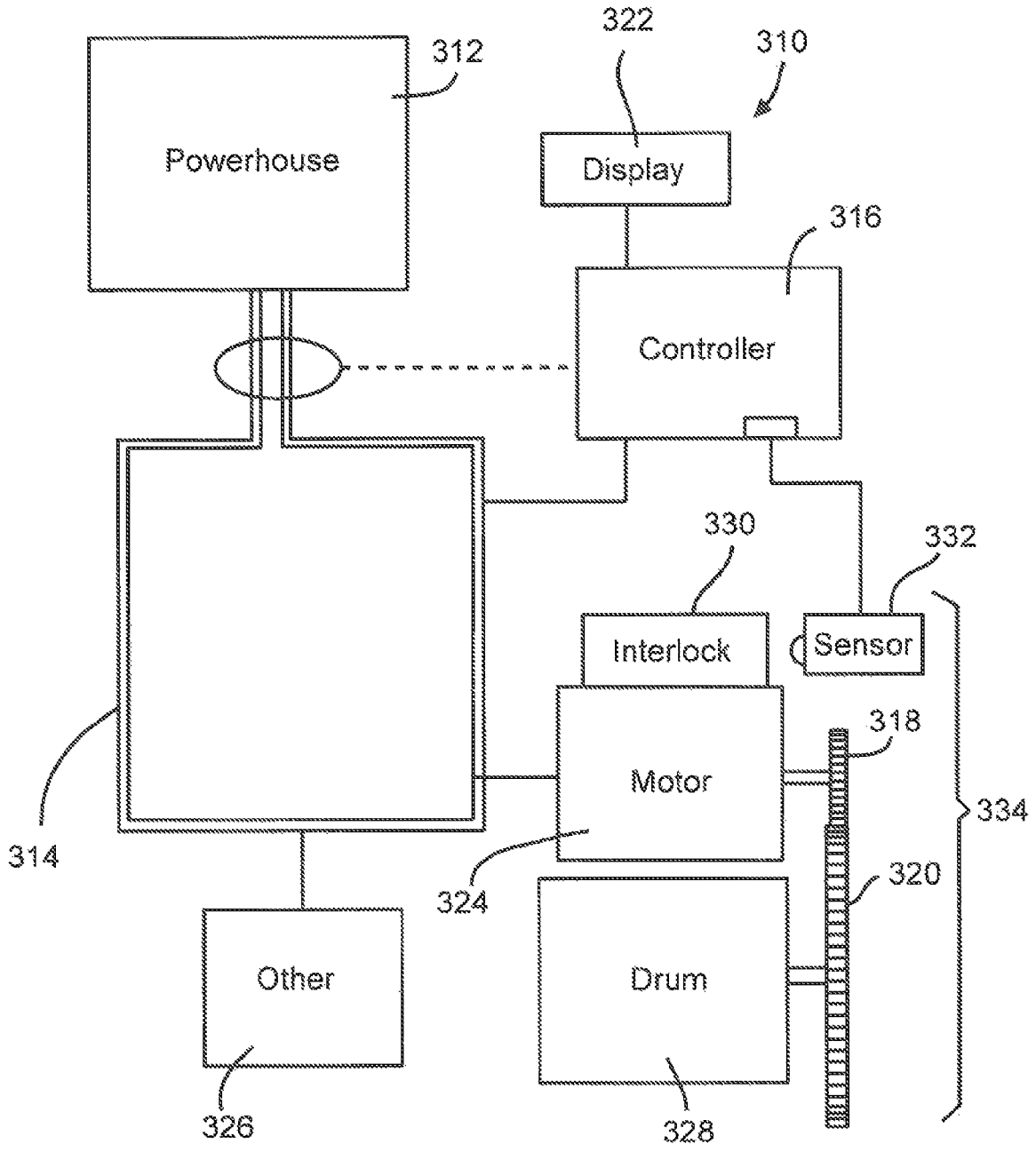
FIG. 10 is a schematic diagram of heavy equipment according to the embodiment of FIG. 1 or according to another exemplary embodiment.

Referring to FIG. 2, a hoist 210 (e.g., hoist system, hoist assembly) for use with heavy equipment, such as the power shovel 110 shown in FIG. 1, includes a motor 212 configured to rotate a drum 214. According to an exemplary embodiment, the motor 212 includes a shaft (see, e.g., shaft 216 as shown in FIG. 3) that rotates a drive gear (see, e.g., drive gear 318 as shown in FIG. 10). The drive gear rotates a larger, driven gear 218 (see also driven gear 320 as shown in FIG. 10) coupled to the drum 214 of the hoist 210. In other contemplated embodiments, such as with hoist and drag machinery for a dragline, several motors and associated drive gears may rotate a driven gear of a drum, such as in a planetary gear arrangement or another arrangement (e.g., with chains, belts, intermediate gearing, etc.).

According to an exemplary embodiment, the motor 212 and the drum 214 of the hoist 210 are attached to a platform 220 (e.g., fixed frame, base, housing). The drive gear of the motor 212, the driven gear 218, and the drum 214 each rotate with respect to the platform 220. In some embodiments, the platform 220 is fastened to or integrated with a deck of the heavy equipment (see, e.g., deck 116 of power shovel 110 as shown in FIG. 1). In other contemplated embodiments, a platform is fixed in a hoist room near a mine shaft (e.g., fixed in concrete). In still other embodiments, a platform may move on a rail or gantry.

According to an exemplary embodiment, the motor 212 is an electric motor. The heavy equipment may include a powerhouse (see, e.g., powerhouse 312 as shown in FIG. 10) to power the motor 212 and other components of the heavy equipment. In some such embodiments, the powerhouse may include a generator set, ultra-capacitor banks, etc. coupled to the motor via an electrical bus (see, e.g., DC bus 314 as shown in FIG. 10). In other embodiments, the heavy equipment may be coupled to an external source of electricity. A computerized controller (see, e.g., controller 316 as shown in FIG. 10) may manage power transfer over the bus. In other embodiments, a combustion engine may be used in place of the electric components.

Figure 8:
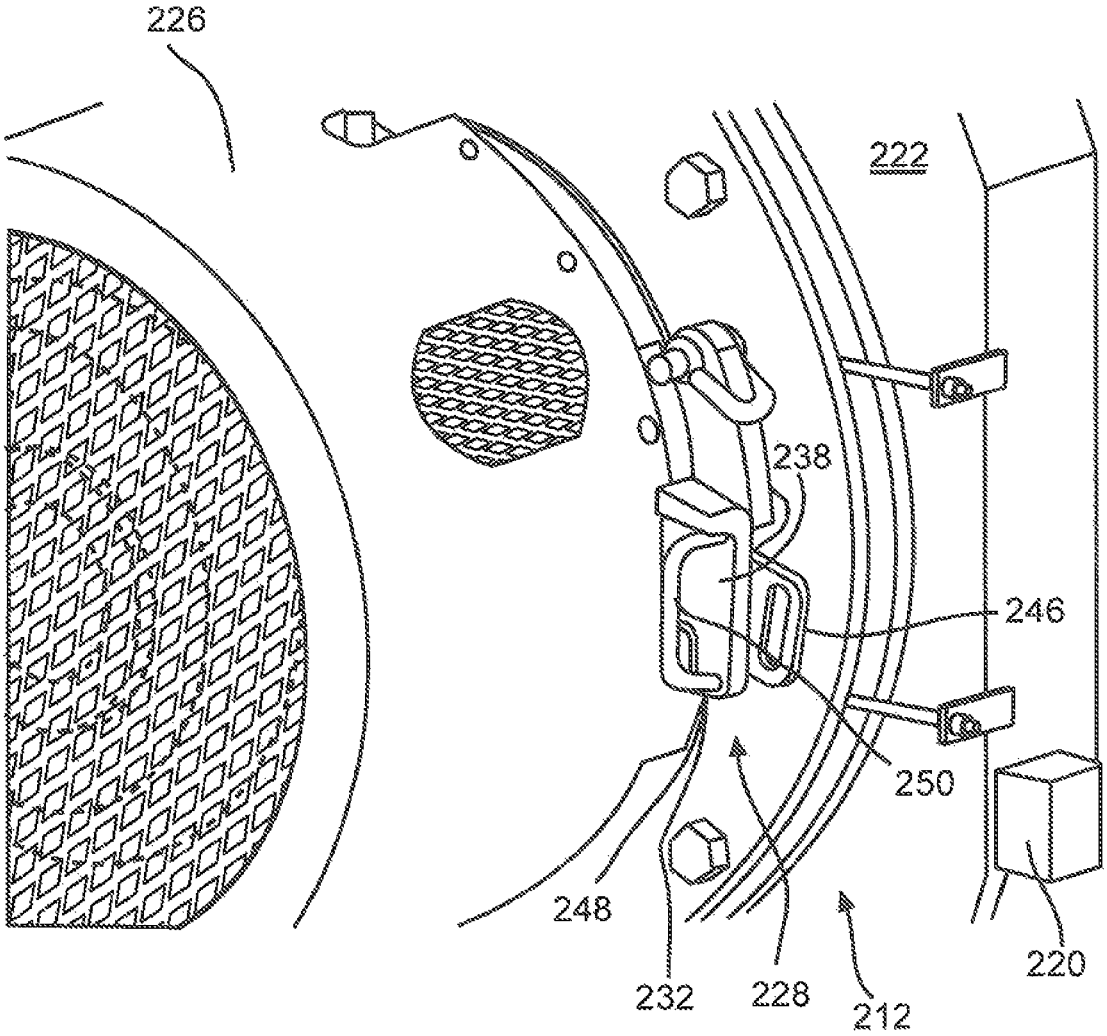
FIG. 8 is a perspective view of the interlock system of FIG. 3 in an interlocked configuration.
Figure 9:
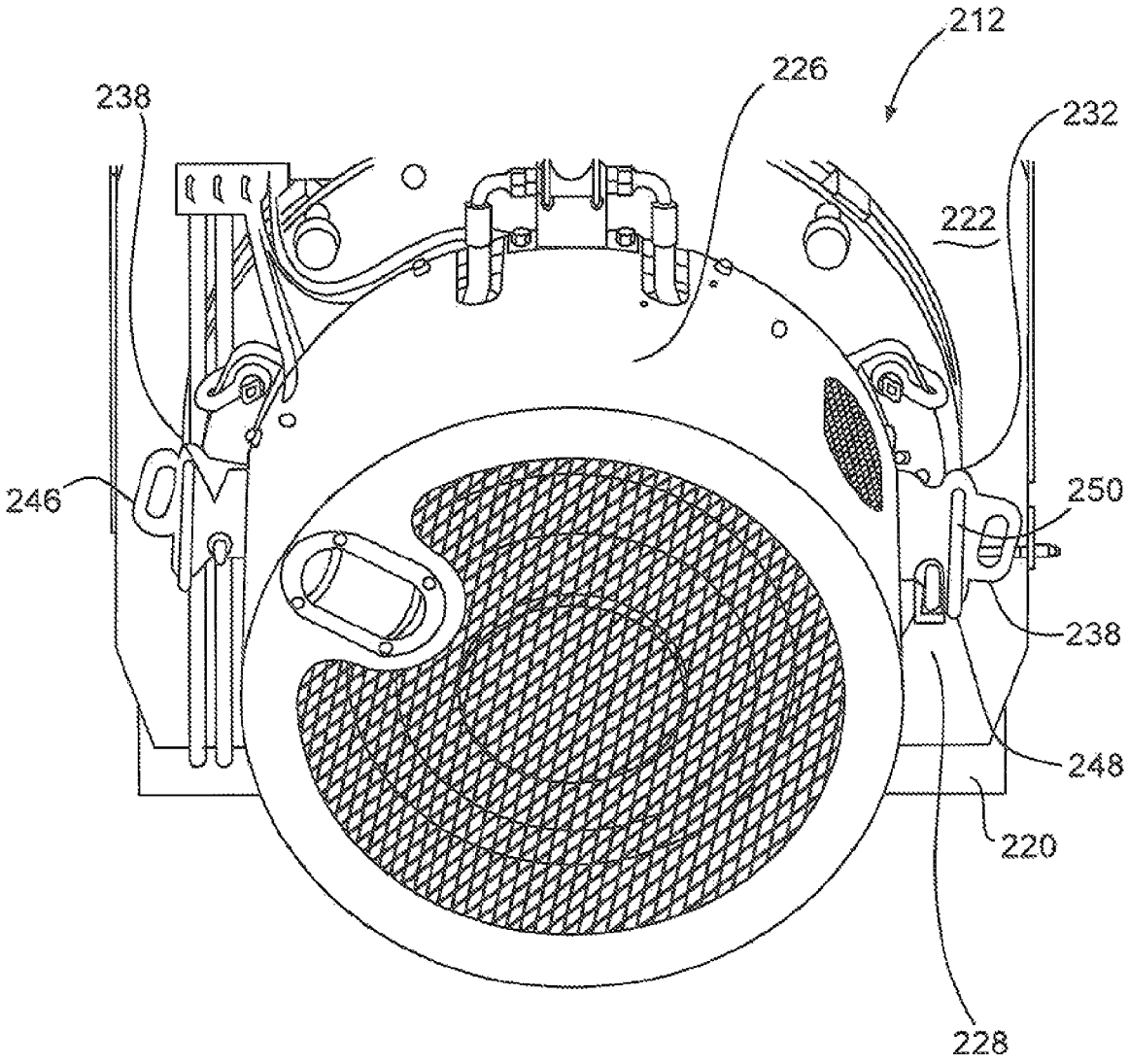
FIG. 9 is another perspective view of the interlock system of FIG. 3 in the interlocked configuration.

Still referring to FIG. 2, the motor 212 of the hoist 210 is supported by a housing 222 that is integrated with the platform 220 (e.g., fixed with respect to the rest of the platform 220, bolted to the rest of the platform 220, mounted to another portion of the platform 220). A fan 224 is coupled to the housing 222 of the motor 212 for cooling the motor 212. Furthermore, a brake 226 is coupled to the housing 222 of the motor 212 on a side of the motor 212 opposite to the drive gear (see also FIGS. 8-9).

Referring now to FIGS. 2-9, the hoist further 210 includes an interlock system 228, which may be used to lock down the hoist 210 (or portion(s) thereof) during maintenance, inspection, repair, etc. of the motor 212, the drum 214, or other components of the hoist 210 or heavy equipment. According to an exemplary embodiment, the interlock system 228 is configured to be engaged and disengaged by a single human operator, and provides a robust interlock intended to securely prevent rotation of the associated shaft (e.g., motor shaft 216, spool, axle, etc.). In FIGS. 3-9, the interlock system 228 is associated with the shaft 216 of the motor 212. In some embodiments, the interlock system 228 is positioned on the exterior of the housing of the motor 212, between the brake 226 and the housing 222.

Referring specifically to FIGS. 3-7, the housing 222 of the motor 212 include a recess 230 on a side of the housing 222 within which a locking bar 232 is positioned. In other embodiments, the locking bar 232 is positioned on the other side of the motor 212, between the housing 222 of the motor 212 and the drive gear (see, e.g., drive gear 318 as shown in FIG. 10) or within the housing 222. In still other contemplated embodiments, the interlock system 228 may be coupled to the drive gear, the driven gear 218, the hub 234 of the drum 214, another component of the hoist 210, or another shaft or rotating body that is not associated with the hoist 210.

According to an exemplary embodiment, the interlock system 228 includes the locking bar 232. In some embodiments, the locking bar 232 includes a keyed ring 236 and arms 238 (e.g., extensions, projections) extending away from the keyed ring 236. The locking bar 232 may include one arm, two arms, three arms, or more. However, in a preferred embodiment, the locking bar 232 includes two symmetrically opposing arms 238 that distribute torque loads. Symmetric arrangement of the arms 238 may reduce stress concentrations.

According to an exemplary embodiment, the shaft 216 of the motor 212 includes a splined section 240. In some embodiments, the keyed ring 236 of the locking bar 232 is configured to slide onto or off of the splined section 240 such that grooves of the keyed ring 236 receive teeth of the splined section 240, interlocking the keyed ring 236 and the splined section 240 of the shaft 216. The arms 238 of the locking bar 232 provide leverage upon the keyed ring 236 to limit rotation of the keyed ring 236 and interlocking splined section 240.

Guides 242 extend from the housing 222 of the motor 212, which limit the movement of the locking bar 232 substantially to axial translation into and out of the recess 230, as well as allowing a limited degree of rotation (e.g., preferably less than ten degrees; more preferably about five degrees) about the rotational axis of the shaft 216. The guides 242 allows limited rotation for the locking bar 232 so that the keyed ring 236 may be aligned with the teeth of the splined section 240 of the shaft 216 during engagement of the locking bar 232. In some embodiments, the teeth of the splined section 240 are provided around the shaft 216 about every four degrees.

In some embodiments, the guides 242 extend through slots 244 (see FIG. 7) in the locking bar 232, where the slots 244 allow the limited degree of rotation of the locking bar 232 relative to the guides 242 and about the axis of rotation of the shaft 216. The guides 242 further include heads (e.g., stoppers) that are sized wider than the slots 244 such that the locking bar 232 is constrained to a limited distance of axial translation. In other contemplated embodiments, hooks, guides, or other structural constraints may extend around the outside of the locking bar 232 or through slots in the locking bar 232.

According to an exemplary embodiment, locking bar 232 includes handles 250. The handles 250 may be positioned proximate to ends of the arms 238 of the locking bar 232, which may facilitate maneuvering (e.g., rotating, axially sliding) the locking bar 232 to engage or disengage the shaft 216 of the motor 212. In some embodiments, a benefit of the locking bar 232 having two arms 238 is that the configuration, including the placement of the handles 250, ergonomically supports activation of the interlock system 228 by a single operator.

According to an exemplary embodiment, the locking bar 232 may be configured in a stored position (e.g., first configuration), where the keyed ring 236 is not engaged with the splined section 240. Put another way, the splined section 240 of the shaft 216 is free to rotate with respect to the keyed ring 236 of the locking bar 232 when in the stored position. The locking bar 232 may further be configured in an interlocked position (e.g., second configuration), where the keyed ring 236 is engaged with the splined section 240 and limits rotation of the shaft 216 (compare the stored or unlocked position of the locking bar 232 shown FIG. 4, which shows the locking bar fastened adjacent to the motor housing 222, with the transition of the locking bar 232 to the interlocked position shown in FIG. 7, which shows the locking bar 232 unfastened to the motor housing 222, and the interlocked position shown in FIG. 8, which shows the locking bar 232 fastened apart from the motor housing 222 where the locking bar 232 is interlocking the splined section 240 of the shaft 216 behind the brake 226).

In some embodiments, the interlock system 228 includes wedges 246 (e.g., locking wedges, spacers, blocks) configured to facilitate positioning the locking bar 232 in either the stored or interlocked configurations. Inserting the wedges 246 between the locking bar 232 and the housing 222 moves the locking bar 232 forward, onto engagement with the splined section 240 of the shaft 216. During normal operation of the hoist 210, the locking bar 232 is in the stored or unlocked position, in which the locking bar 232 is fastened (e.g., bolted in place) with the wedges 246 on a front or forward face of the locking bar 232, opposite to the housing 222 of the motor 212, thus permitting the splined section 240 of the shaft 216 to rotate freely with respect to the keyed ring 236. During maintenance, repair, inspection, etc. of the hoist 210, the locking bar 232 may be reconfigured in the interlocked position, in which the operator removes the wedges 246 from the front of the locking bar 232, slides the locking bar 232 forward, and then fastens the locking bar 232 with the wedges 246 positioned between the locking bar 232 and the housing 222 of the motor 212.

According to an exemplary embodiment, a notch 258 (e.g., slot, opening; see FIGS. 3 and 5) in the wedge 246 is configured to be received by a portion of the guide 242 limiting axial and rotational movement of the locking bar 232. Additionally both the wedge 246 and the locking bar 232 may be fastened to the housing 222 of the motor 212 with the same fastener 248 (e.g., pin, bolt, linchpin, etc.). Regardless of whether the locking bar 232 is in the stored or interlocked position, the notch 258 in the wedge 246 is received by the guide 242 on either side of the locking bar 232, and the wedge 246 is fastened along with the locking bar 232 to the housing 222 with the fastener 248.

Figure 4:
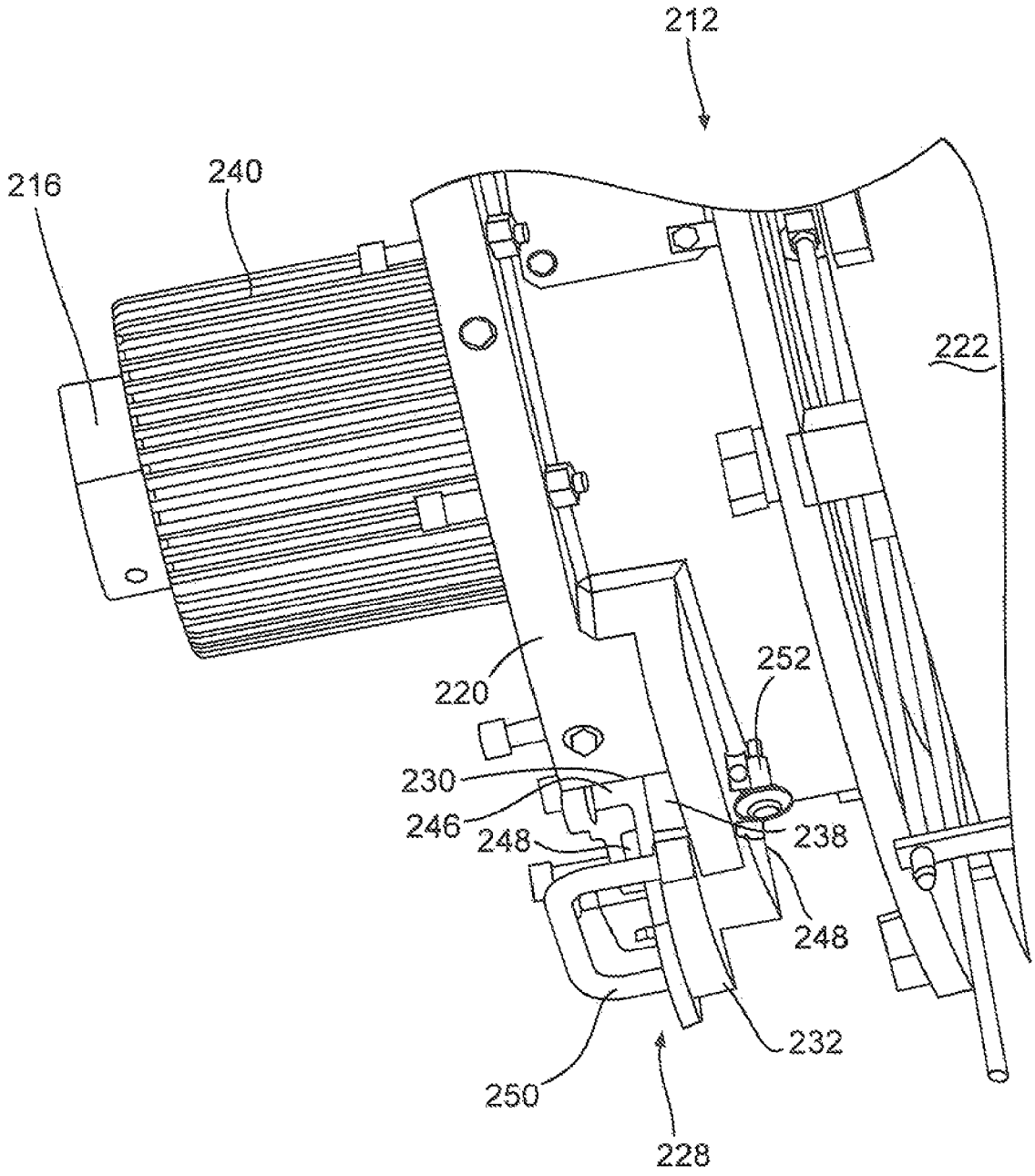
FIG. 4 is a perspective view of the interlock system of FIG. 3.
Figure 5:
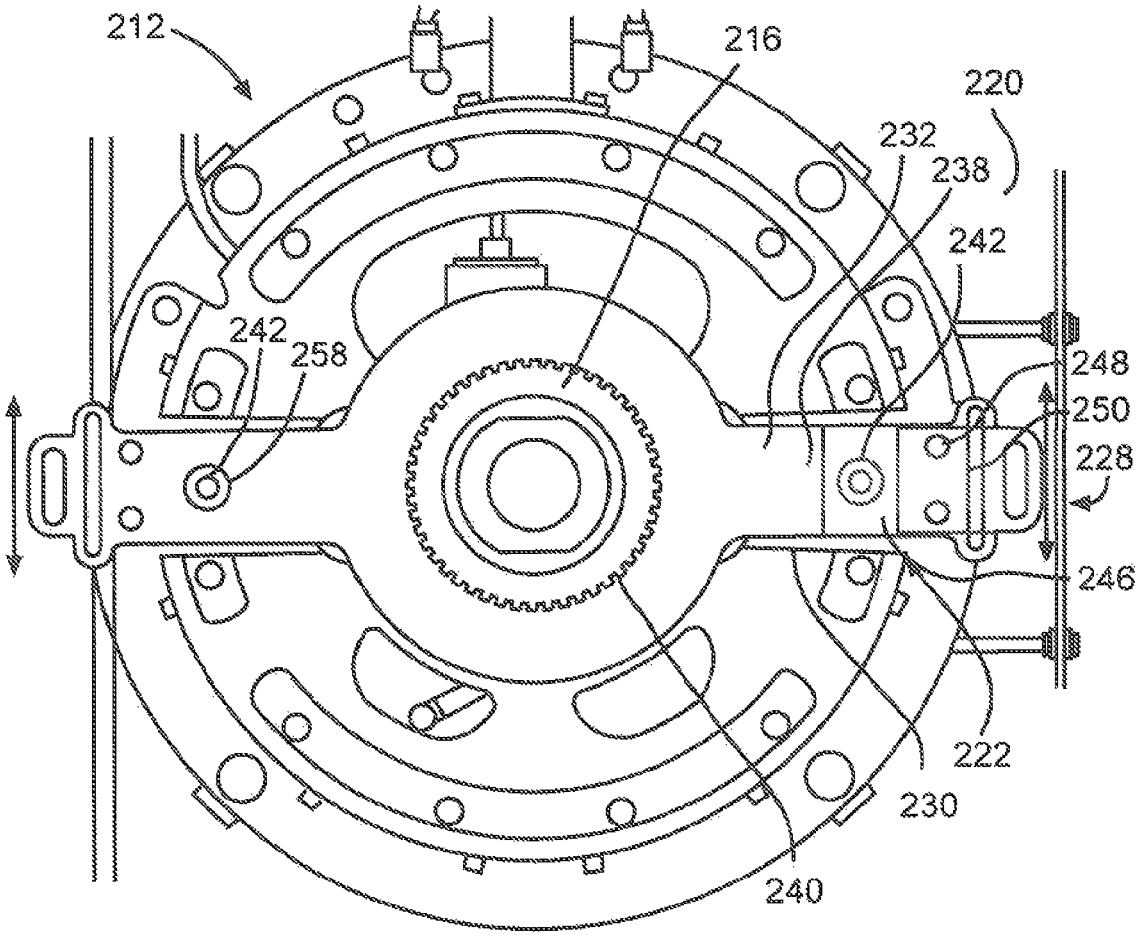
FIG. 5 is a side view of the interlock system of FIG. 3.
Figure 6:
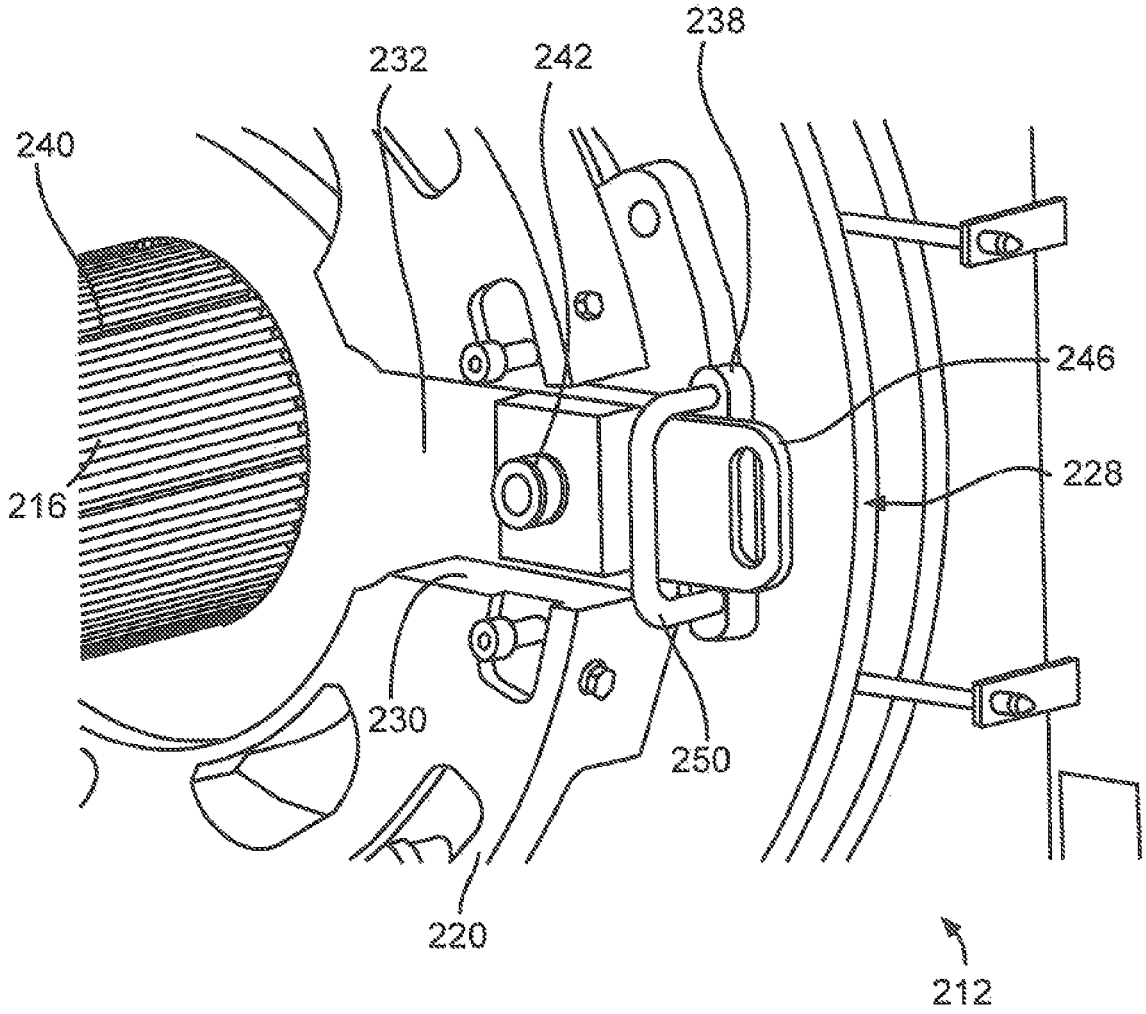
FIG. 6 is a perspective view of the interlock system of FIG. 3 in a stored configuration.
Figure 7:
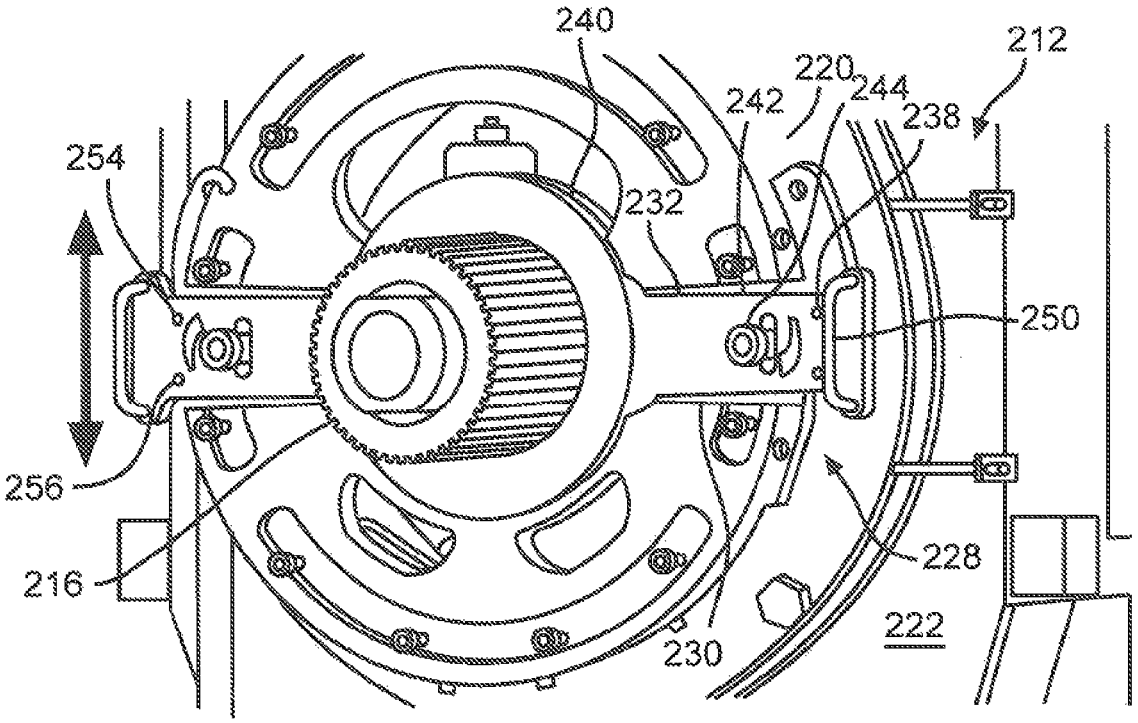
FIG. 7 is a perspective view of the interlock system of FIG. 3 in a transition configuration.

Referring to FIG. 4, the fastener 248 is shown as a pin-bolt that extends through the wedge 246 and the arm 238 of the locking bar 232 to be received in the housing 222 of the motor 212. A sensor 252 coupled to the interlock system 228 is configured to actively detect the presence of the fastener 248 when the fastener 248 is holding the locking bar 232 in the stored configuration. The sensor 252 is further configured to provide a signal indicative of the presence (or absence) of the fastener 248 to a computerized controller. Correspondingly, via a lack of the signal, the sensor 252 also communicates to the controller a state of the fastener 248, such as that the fastener 248 is loose or absent.

In some embodiments, the fastener 248 being loose or absent may be communicated to an operator by the controller via a display (see, e.g., display 322 as shown in FIG. 3). Such a condition may also initiate a shutdown sequence of the heavy equipment, or may prevent operation of the hoist 210. In some embodiments, if during operation of the hoist 210, the sensor 252 fails to detect that the fastener 248 is in the proper position, the controller will reduce the drive reference of the heavy equipment (e.g., power shovel) to less than fifty percent (e.g., about twenty percent) and will indicate via the display to the operator that a shutdown sequence will occur or is occurring.

According to an exemplary embodiment, both the wedge 246 and the arm 238 include two bolt holes 254, 256 (see FIG. 7) for receiving a fastener 248 to attach the locking bar 232 to the housing 222. One bolt hole 254, such as the upper hole, is intended to be used by the operator when the locking bar 232 is in the stored position. The other bolt hole 256, such as the lower hole, is intended to be used when the locking bar 232 is in the interlocked position. Accordingly, in the exemplary embodiment, the sensor 252 is configured to detect the presence of the fastener 248 when the fastener 248 is in the one bolt hole 254, and not the other bolt hole 256. The sensor 252 can be positioned in other places to detect whether the interlock system 228 is in the locked or unlocked configuration. Furthermore, the sensor 252 may positively detect the absence of the fastener 248 or another state of the system (e.g., strain gauge or load cell detecting compression between the locking bar 232 and the housing 222).

The fastener 248 used to hold the locking bar 232 in the interlocked position may include a pin-bolt secured with a jam nut. The shank of the pin-bolt may include an aperture for receiving a pad lock. Accordingly, to secure the fastener 248 with the locking bar 232 interlocked, the jam nut may be held in position by the pad lock. Alternatively or in addition thereto, a tag may be inserted through the aperture, providing information, such as that the hoist is presently interlocked and secure.

Referring to FIG. 10, heavy equipment 310 includes a hoist 334 and a powerhouse 312. The heavy equipment 310 may be similar to the power shovel 110, or may be another item of power equipment. A computerized controller 316 and an electric motor 324 receive power from the powerhouse 312 via a bus 314. Other components 326 of the heavy equipment 310 may also be coupled to the bus 314. The motor 324 rotates a drive gear 318, which rotates a driven gear 320 coupled to a drum 328 of the hoist 334.

An interlock system 330 is coupled to the motor 324 and a sensor 332 detects and communicates a signal to the controller 316 that is indicative of the configuration of the interlock system 330. The controller communicates associated information, such as a state of the interlock system 330, to an operator on a display 322. Furthermore, the controller 316 is configured to regulate power on the bus 314, or to components coupled to the bus 314, as a function of the configuration of the interlock system 330, such as by opening a switch or relay to cut power to the motor 324 or other components.

In contemplated embodiments, the interlock system may be remotely engaged by an operator. In some such embodiments, solenoids may release (e.g., unpin or unlatch) fasteners holding the locking bar in the stored position. A motor and gear reduction other actuator may rotate the locking bar or shaft to align the keyed ring with the splined section. Optical sensors may be used to facilitate alignment of the splined and keyed elements by recognizing optical indicators (e.g., indexing symbols) positioned on each of the interconnecting pieces.

Furthermore, in some contemplated embodiments, the fasteners attaching the locking bar in the stored position may include electromagnets that overcome springs. The springs may bias the locking bar to the interlocked configuration, but are overpowered by the electromagnets when the hoist is powered. When power is cut to the hoist, the electromagnets release the locking bar, which allows the springs to move the locking bar to interlock the hoist as a default position.

The construction and arrangements of the hoist, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. In contemplated embodiments, the interlock system may be used to lock shafts other than drive shafts (e.g., axles), or may be used with motors that are not coupled to hoists or other winches. In some embodiments, interlocking elements other than a spline and keyed grooves are used between the locking bar and the shaft (e.g., pins in locking bar received by holes in shaft; clamp on locking bar; locking bar extending through channel within shaft, etc.). The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A hoist, comprising:

a platform;

a drum supported by and configured to rotate with respect to the platform;

a motor coupled to the drum and configured to rotate the drum;

a shaft having a splined section and coupled to at least one of the drum and the motor, wherein the shaft communicates torque between the drum and the motor; and an interlock system, comprising:

a keyed ring configured to slide onto and engage the splined section of the shaft;

an arm extending from the keyed ring, wherein the arm is configured to provide leverage to limit rotation of the keyed ring and thereby interlocking rotation of the shaft when the keyed ring is engaged with the splined section of the shaft;

a guide for the arm; and a fastener configured to extend through a hole in the arm to hold the arm in a fixed position with respect to the guide;

wherein the arm comprises two holes configured to receive the fastener, wherein a first of the two holes is configured to receive the fastener when the keyed ring is engaged with the splined section of the shaft and the second hole is configured to receive the fastener when the keyed ring is not engaged with the splined section of the shaft.

2. The hoist of claim 1, wherein the guide is fixed with respect to the platform and the arm is configured to slide axially along the guide so that the keyed ring may engage the splined section of the shaft.

3. The hoist of claim 2, wherein the guide comprises a stopper on an end thereof that limits the axial translation of the arm.

4. The hoist of claim 3, wherein the guide is configured to allow a limited amount of rotation of the arm and keyed ring so that the keyed ring may be aligned with teeth of the splined section of the shaft, and wherein the limited amount of rotation is less than ten degrees.

5. The hoist of claim 1, wherein the fastener is a pin, and the hoist further comprises a sensor proximate to the first hole, wherein the sensor is configured to detect and provide a signal corresponding to the pin extending through the first hole, thereby indicating a status of the interlock system.

6. The hoist of claim 5, further comprising a computerized controller in communication with the sensor, wherein the computerized controller comprises a logic module for at least partially operating the hoist as a function of the signal.

7. The hoist of claim 6, wherein, in response to absence of the signal, the computerized controller is configured to at least one of:

prevent the hoist from operating; and initiate a shutdown sequence of the hoist.

8. The hoist of claim 1, wherein the fastener comprises a nut and a bolt, wherein the bolt has an aperture in a shank of the bolt, and wherein the bolt is configured to be fastened to the arm through the second hole with the nut interposed between the arm and a padlock extending through the aperture in the shank to lock the arm with the keyed ring engaged with the splined section of the shaft.

9. The hoist of claim 1, wherein the interlock system further comprises a wedge configured to be coupled to opposite sides of the aim with the fastener, wherein the wedge positions the aim such that the keyed ring engages the splined section of the shaft when the wedge is coupled to one side of the arm, and wherein the wedge positions the arm such that the keyed ring disengages the splined section of the shaft when the wedge is coupled to the other side of the arm.

10. The hoist of claim 9, wherein the wedge has a notch configured to receive the guide.

11. The hoist of claim 1, further comprising a second arm extending from the keyed ring opposite to the arm, wherein the arm, the second arm, and the keyed ring together form an integral locking bar.

12. The hoist of claim 11, further comprising a brake for the motor, wherein the locking bar engages the shaft between the motor and the brake.

13. A hoist, comprising:

a platform;

a drum supported by and configured to rotate with respect to the platform;

a motor coupled to the drum and configured to rotate the drum;

a shaft having a splined section and coupled to at least one of the drum and the motor, wherein the shaft communicates torque between the drum and the motor; and an interlock system, comprising:

a keyed ring configured to slide onto and engage the splined section of the shaft;

an arm extending from the keyed ring, wherein the arm is configured to provide leverage to limit rotation of the keyed ring and thereby interlocking rotation of the shaft when the keyed ring is engaged with the splined section of the shaft;

a guide for the arm;

a fastener configured to extend through a hole in the arm to hold the arm in a fixed position with respect to the guide;

a wedge configured to be coupled to opposite sides of the arm with the fastener, wherein the wedge positions the arm such that the keyed ring engages the splined section of the shaft when the wedge is coupled to one side of the arm, and wherein the wedge positions the arm such that the keyed ring disengages the splined section of the shaft when the wedge is coupled to the other side of the arm.

14. The hoist of claim 13, wherein the wedge has a notch configured to receive the guide.

15. The hoist of claim 13, wherein the guide is fixed with respect to the platform and the arm is configured to slide axially along the guide so that the keyed ring may engage the splined section of the shaft.

16. A hoist, comprising:

a platform;

a drum supported by and configured to rotate with respect to the platform;

a motor coupled to the drum and configured to rotate the drum;

a shaft having a splined section and coupled to at least one of the drum and the motor, wherein the shaft communicates torque between the drum and the motor; and an interlock system, comprising:

a keyed ring configured to slide onto and engage the splined section of the shaft;

an arm extending from the keyed ring, wherein the arm is configured to provide leverage to limit rotation of the keyed ring and thereby interlocking rotation of the shaft when the keyed ring is engaged with the splined section of the shaft; and a second arm extending from the keyed ring opposite to the arm, wherein the arm, the second arm, and the keyed ring together form an integral locking bar.

17. The hoist of claim 16, further comprising a brake for the motor, wherein the locking bar engages the shaft between the motor and the brake.

18. The hoist of claim 16, wherein the interlock system further comprises a guide for the arm, wherein the guide is fixed with respect to the platform and the arm is configured to slide axially along the guide so that the keyed ring may engage the splined section of the shaft.

* * * * *